US005605413A

United States Patent [19]

Brown

[11] Patent Number: 5,605,413

[45] Date of Patent: Feb. 25, 1997

[54] HIGHWAY BARRICADE

[76] Inventor: James C. Brown, 2121 Skyhawk Dr., Fort Wayne, Ind. 46815

[21] Appl. No.: 494,345

[22] Filed: Jun. 26, 1995

[51] Int. Cl.[6] ..... E01F 15/00

[52] U.S. Cl. ..... 404/6; 404/9; 256/13.1; 52/730.4; 52/730.5

[58] Field of Search ..... 404/6, 9, 12; 256/1, 256/13.1; 52/586, 587, 730.2, 730.4, 730.5

[56] References Cited

U.S. PATENT DOCUMENTS 5,387,049 2/1995 Duckett ..... 404/6
5,425,594 6/1995 Krage et al. ..... 404/6

*Primary Examiner*—Henry A. Bennett
*Assistant Examiner*—Pamela A. O'Connor
*Attorney, Agent, or Firm*—Roger M. Rickert

[57] ABSTRACT

An elongated hollow rotationally molded high density polyethylene highway barrier has two elongated generally parallel sidewalls, two generally vertical end walls, and a plurality of longitudinal reinforcing members extending from one end wall to the other. The longitudinal reinforcing members extend from respective vertical end walls and terminate in loops which may be joined to like loops on an adjacent barrier for interconnecting the barriers. The longitudinal reinforcing members are typically steel cables. In one form, both end walls have central vertical notches arranged so that the notch end of one barrier may be aligned with the notch end of another barrier and the two barriers moved toward one another with the notches aligned. In this form, there are two steel cables passing through longitudinal holes in each barrier to be joined within the two aligned end notches. In another form, one barrier end is notched vertically while the opposite end has a central vertical protrusion. The protrusion and notch are arranged so that the notch end of one barrier may be aligned with the protrusion end of another barrier and the two barriers moved toward one another with the notch receiving the protrusion to aid in maintaining alignment of the two barriers. In this form, there are four steel cables received in external sidewall grooves. Straps may be provided for retaining the cables in the grooves.

17 Claims, 8 Drawing Sheets

Fig. 6a
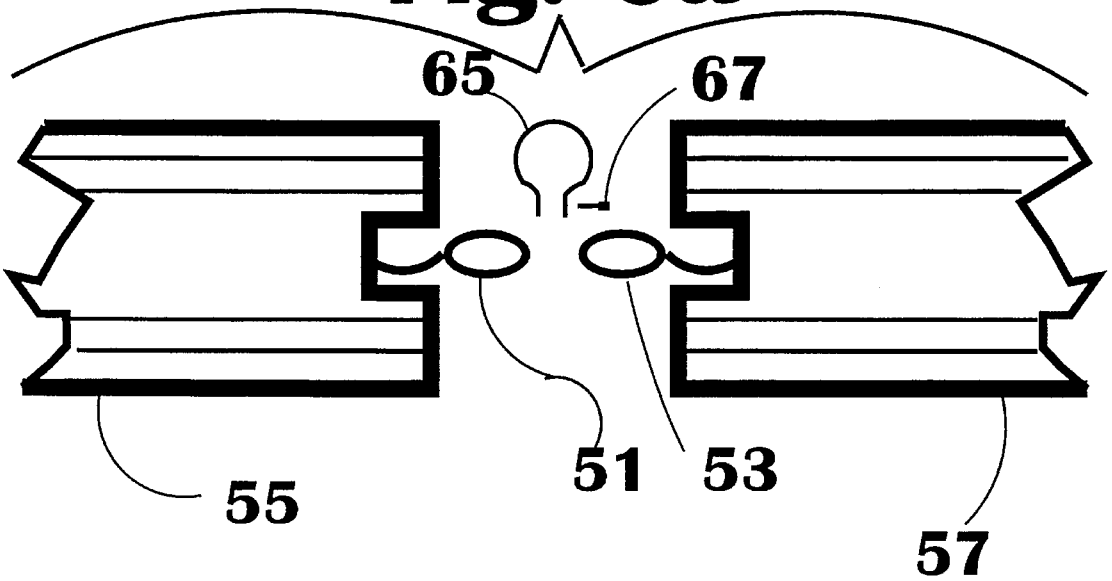
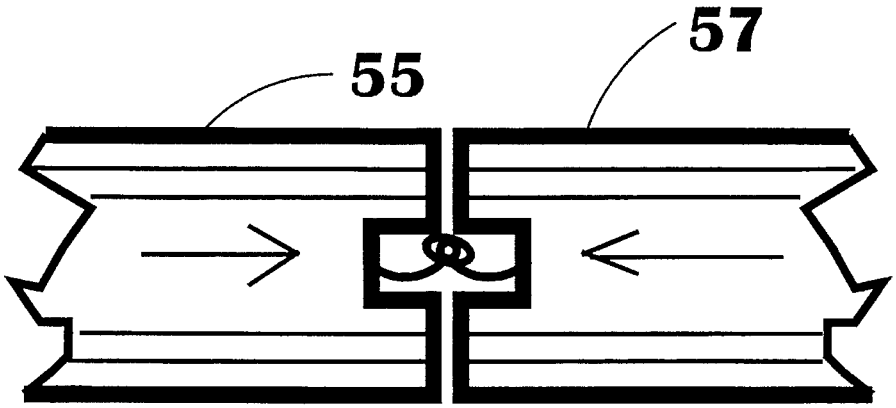
Fig. 6b

HIGHWAY BARRICADE

SUMMARY OF THE INVENTION

The present invention relates generally to barriers and more particularly to barriers of a type frequently used for flood control dikes, as highway barricades and similar uses.

Concrete barriers of the "New Jersey" style are commonplace along the nation's highways. Such concrete barriers are frequently laid end-to-end in construction or other areas as median barriers to prevent vehicles moving in one direction from entering the lane or lanes in which traffic is moving in the opposite direction. It is frequently desired to somehow join individual concrete blocks so that a vehicle impacting one block or barrier will not simply displace that block, but rather, will be forced to displace several blocks thus expending its kinetic energy without breaking through the barricade.

One technique for joining concrete barriers is shown in U.S. Pat. No. 4,059,362 where a vertical tongue-and-groove configuration is provided on opposite ends of individual blocks. This requires the female end of one block to be accurately aligned with the male end of an adjacent block resulting in a time consuming process of placement of individual blocks.

A technique for joining either ends of individual concrete blocks is shown in U.S. Pat. No. 4,661,010. In this patented arrangement, two U-shaped reinforcement irons are cast in each end of the concrete blocks and have connected vertical pins accessible in grooves at the block ends. A removable tube and retaining plate may then be used to join the pins of one barrier to those of an adjacent barrier. While eliminating the Male/female orientation requirement of the previous scheme, this patented arrangement still requires an accurate and time consuming alignment of adjacent blocks.

There have been several attempts to form New Jersey style barriers of materials other than concrete. Hollow structures designed to be filled with water, sand or similar flowable materials at the site where they are being deployed are shown, for example, in U.S. Pat. Nos. 4,681,302 and 5,123,773. Interlocking male and female ends or integrally molded hinge portions at the ends with a removable hinge pin serve to interconnect these devices. Such hollow barrier structures are far lighter and more readily moved from site to site. They are also somewhat resilient and yield on impact to dissipate vehicle kinetic energy more gradually than concrete resulting in reduced occupant injury and vehicle damage.

A recently introduced highway barrier system utilizing individual water-filled containers connected by cables and steel pins again employs integrally molded hinge portions at the ends with the removable hinge pin serving to interconnect adjacent containers. The cables are separate and lie in a trough in the container tops with the pins passing through both loops at the cable ends and the hinge portions. This container system is not of the New Jersey style and is offered by Energy Absorption Systems, Inc. of Chicago, Ill. The interlocking schemes in these last two patented arrangements and this recently introduced container system all suffer from the same drawbacks noted earlier.

Among the several objects of the present invention may be noted the provision of barrier which reduces or eliminates the above-noted drawbacks; the provision of a New Jersey style barrier system having superior interconnection capabilities; the provision of a highway barrier system which is easily deployed, interconnected, and subsequently disassembled for transport to another location; and the provision of an improved water-fillable barrier. These as well as other objects and advantageous features of the present invention will be in part apparent and in part pointed out hereinafter.

In general, an elongated hollow rotationally molded high density polyethylene highway barrier has a pair of elongated generally parallel sidewalls, a plurality of generally vertical internal reinforcing members extending along each sidewall, a plurality of external longitudinally extending reinforcing members, and a plurality of internal transverse reinforcing members spanning the hollow interior between a vertical reinforcing member extending along one side wall and a corresponding reinforcing member extending along the opposite sidewall. Typically, the sidewalls taper slightly toward one another, the longitudinally extending reinforcing members comprise four steel cables, and the transverse reinforcing members comprise flexible cables or chains.

Also in general, and in one form of the invention, an elongated hollow rotationally molded high density polyethylene New Jersey style highway barrier has a pair of elongated generally parallel sidewalls, a pair of generally vertical end walls, at least two removable longitudinal reinforcing members extending from one vertical end wall to the other and extending from respective vertical end walls for joining one barrier to an adjacent barrier. In one form, the barrier has a pair of generally parallel holes extending from one end wall to the other, and the reinforcing members comprise a pair of cables passing through the holes. In another form, the barrier has a pair of generally parallel longitudinally extending cable receiving grooves in each barrier sidewall and the reinforcing members comprising a plurality of cables with one cable disposed in each groove. In either form, each cable has a bight at each free end for connection with a like cable bight extending from an end of an adjacent barrier.

BRIEF DESCRIPTION OF THE DRAWING

FIG. 6*a* is a top view of portions of two barriers of the style of FIGS. 1–3 illustrating the technique of joining those barriers;

FIG. 6*b* shows the two barrier portions of FIG. 6*a* joined; and

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
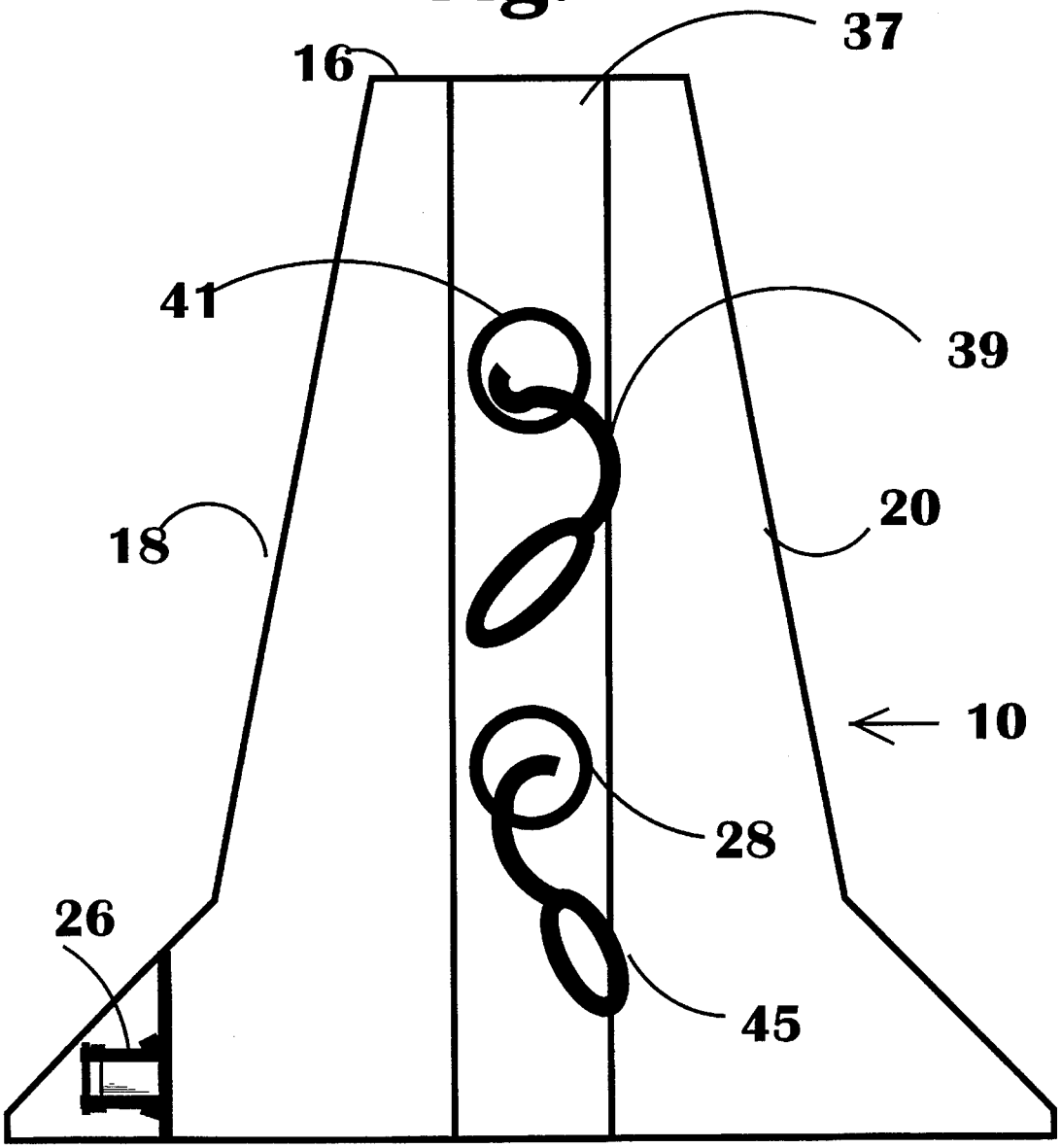
FIG. 1 is an end elevational view of a barrier incorporating my invention in one form.
Figure 2:
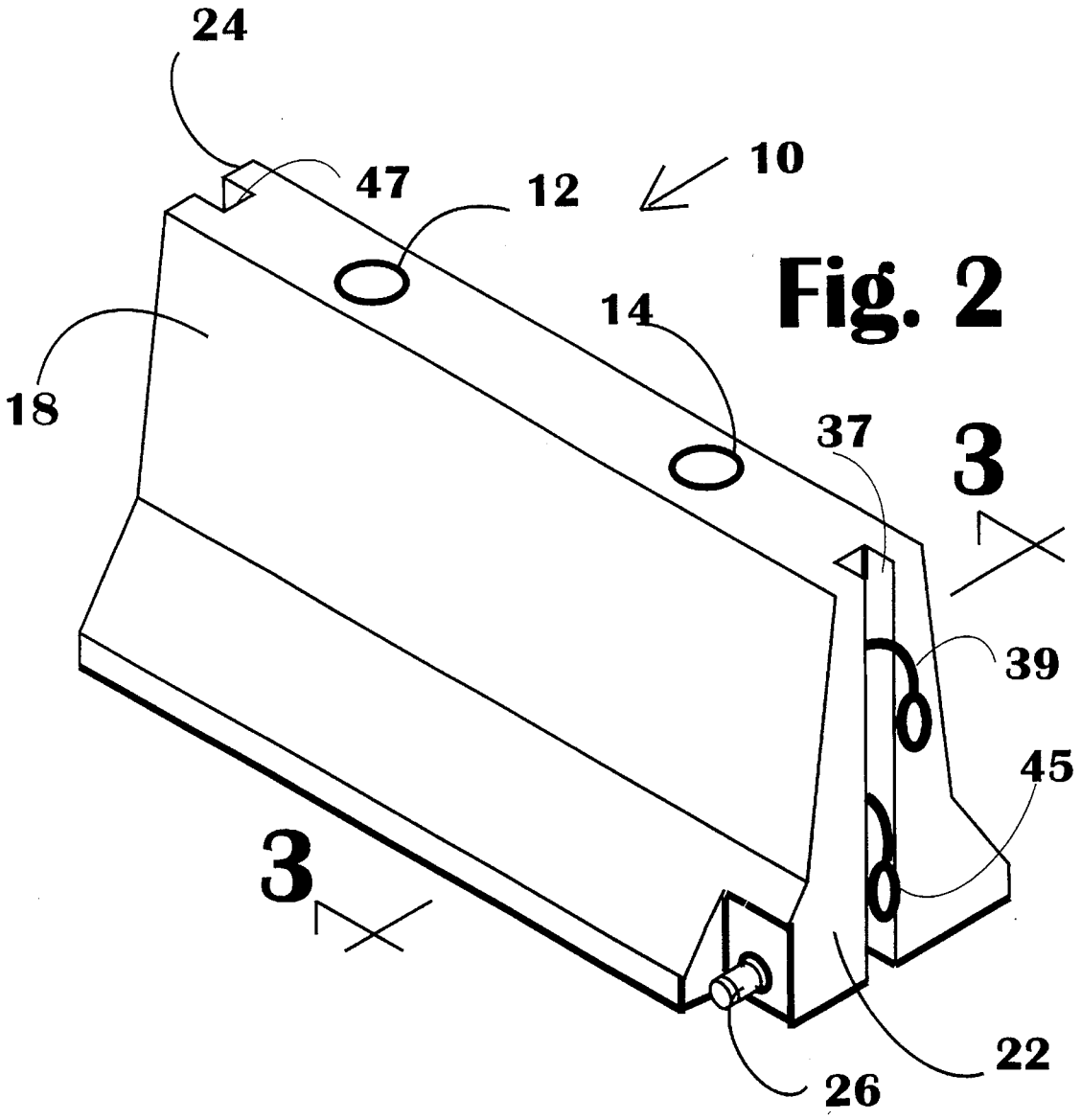
FIG. 2 is an isometric view of the barrier of FIG. 1.

Referring first to FIGS. 1 and 2, the elongated hollow rotationally molded high density polyethylene highway barrier 10 has a pair of filler holes 12 and 14 for filling the barrier with water once it is in position. A pair of caps (not shown) for closing the holes 12 and 14 are typically provided. A pair of drain fittings such as 26 are provided at diametrically opposite corners of the base for draining water preparatory to moving the barrier from one site to another. The filler holes 12 and 14 along with a pair of short ropes with a cross-member at each end also provide one way for four workers to carry an empty barrier. A shorter one of the cross-members is lowered lengthwise through the hole them reoriented crosswise to engage the bottom surface of the top 16. The longer cross-member spans the transverse width of the barrier and one worker lifts on each cross-member end. A hand truck of the type frequently used in moving heavy objects may also be used to move an empty barrier.

Figure 3:
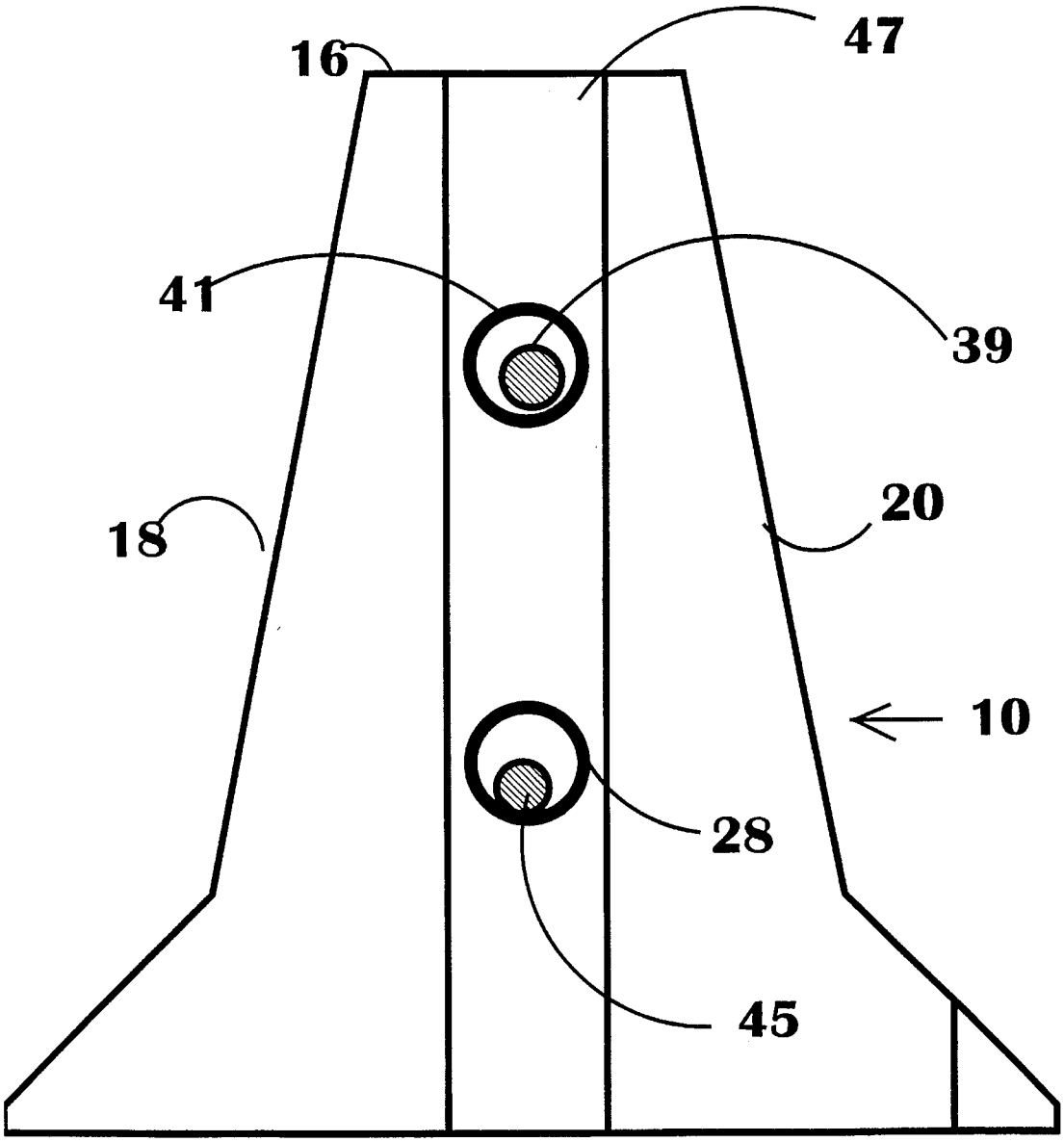
FIG. 3 is view in cross-section along lines 3—3 of FIG. 2.

The barrier 10 has a pair of elongated generally parallel sidewalls 18 and 20. As best seen in FIGS. 1 and 3, these sidewalls are only generally parallel and taper somewhat toward one another. Typically, each sidewall is inclined to the vertical by about 3½ degrees. Barrier 10 also has a pair of generally vertical end walls 22 and 24 with respective central vertical notches 37 and 47. There are two internal longitudinal reinforcing members 28 and 41 in the form of a pair of hollow tubes of about four inch diameter extending through the end walls 22 and 24 to provide a pair of hollow cores through the barrier from one end to the other. The tubes could be metal, but are preferably plastic. Tubes 28 and 41 can be formed by molding at the same time as the barrier, or may be separate tubes inserted in holes and welded in place at a later time. The cables 39 and 45 extend from respective vertical end walls. These cables are typically about ¾ inches in diameter and facilitate joining one barrier to an adjacent barrier as described in conjunction with FIGS. 6*a* and 6*b*.

Figure 6C:
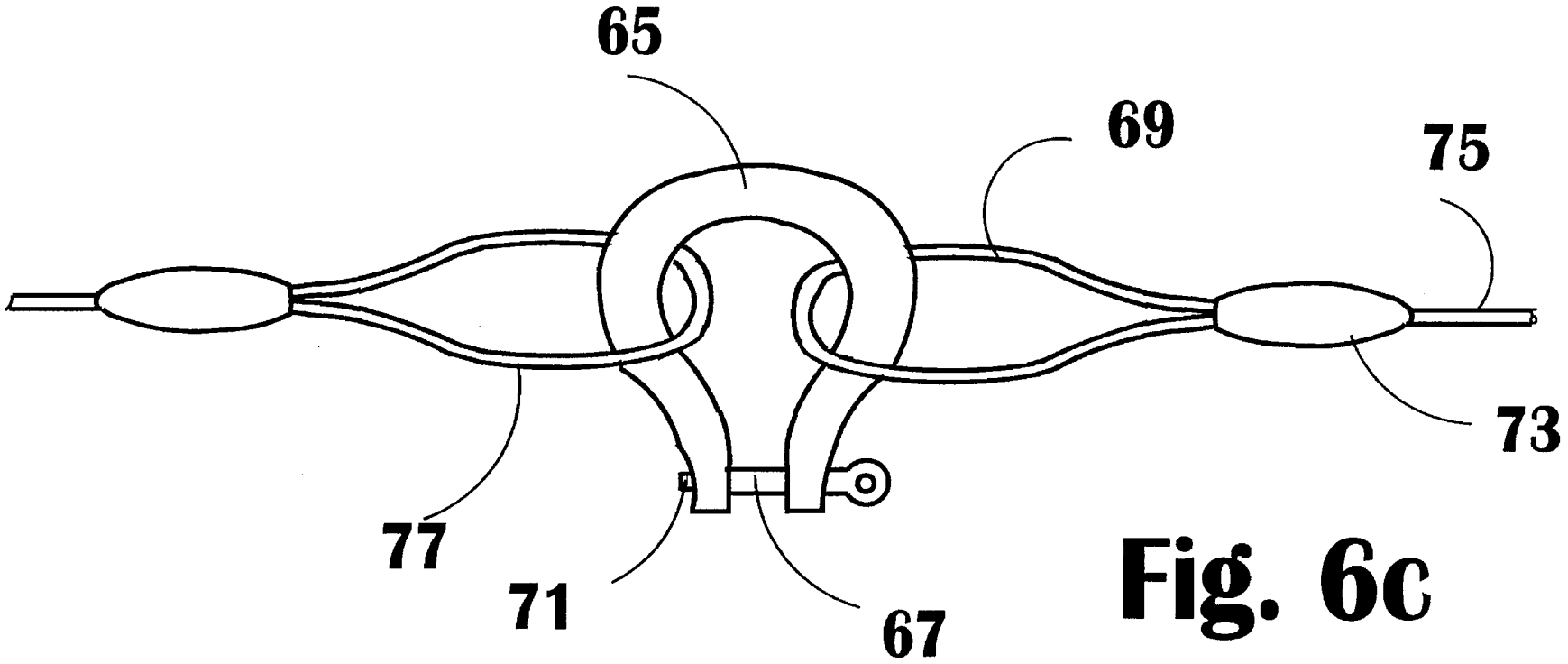
FIG. 6*c* is an enlarged view of a portion of FIG. 6*b* showing two cable bights and the joining clevis.

Turning now to FIGS. 6*a* and 6*b*, the notch end of one barrier 55 is aligned with the notch end of another barrier 57. Those two barriers are moved toward one another in transitioning from FIG. 6*a* to FIG. 6*b*. As they move toward one another, the cable bights 51 and 53 may be superimposed and a pin passed through both bights to join and aid in maintaining alignment of the two barriers. Preferably, a clevis such as 65 is looped through each bight 51 and 53. Of course, the arrangement for joining one barrier to an adjacent barrier actually comprises a pair of cables such as 39 and 45, and a like pair on the adjacent barrier, and if a single connecting pin is used, it passes through both pairs of end loops or bights. A clevis is preferred over a pin because, in some accident/impact situations, a pin could become dislodged and become a dangerous moving projectile. Only one pair of cables is shown in FIGS. 6*a* and 6*b* for clarity. Also, each cable passes entirely through a corresponding tube, and each cable has a bight at each free end for connection with a like cable bight extending from an end of an adjacent barrier. The loops or bights 51 and 53 may be a so-called Flemish eye as shown in FIG. 6*c*, or may simply be formed by a forming a loop in the cable and applying a cable clamp.

It may be difficult to join the lower pair of cables with a clevis such as 65 by reaching down from the barrier tops. If so, the barriers may be left on their sides and the lower cables connected from the barrier bottom. Then the barriers may be turned to their upright position and the upper cable pair connected.

Figure 4:
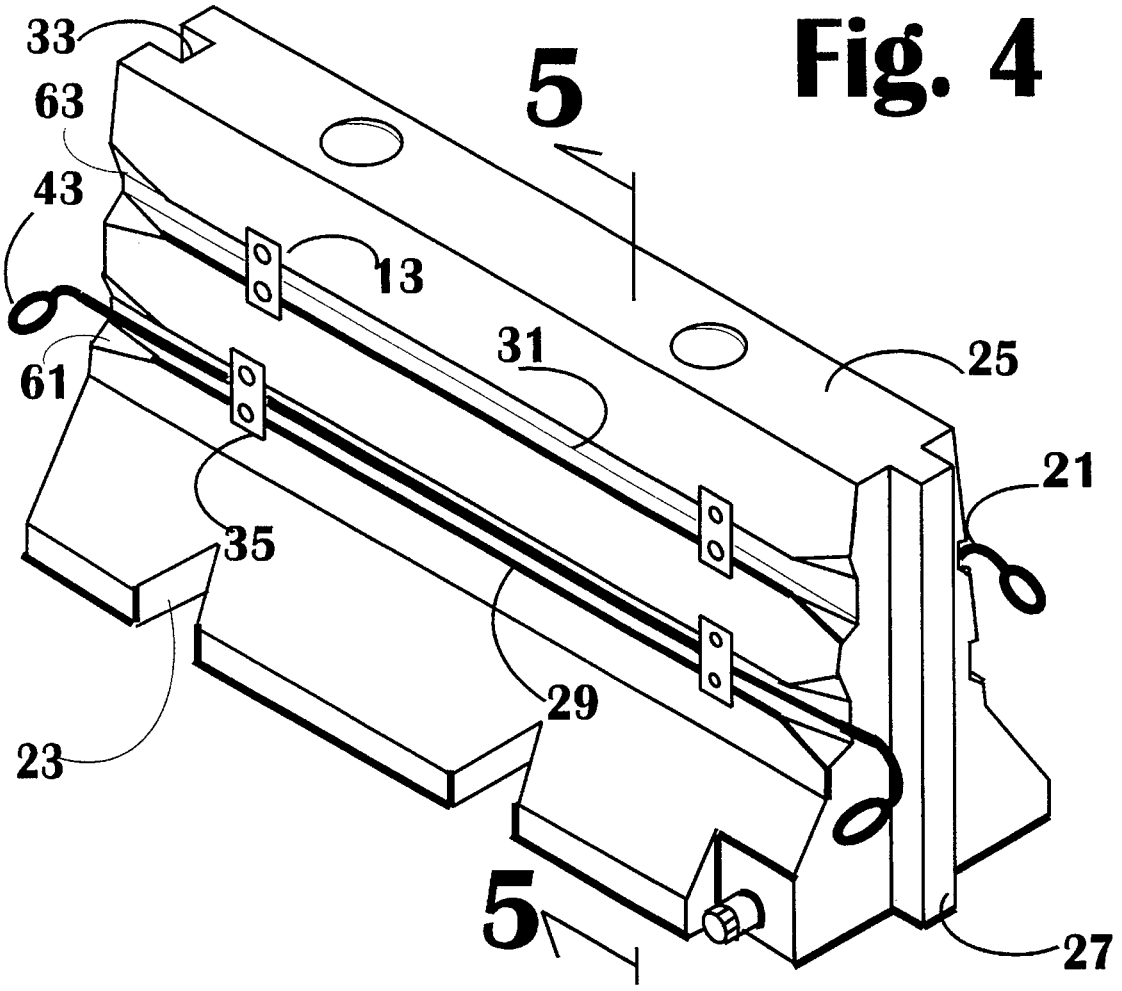
FIG. 4 is an isometric view of a barrier illustrating my invention in another form.
Figure 5:
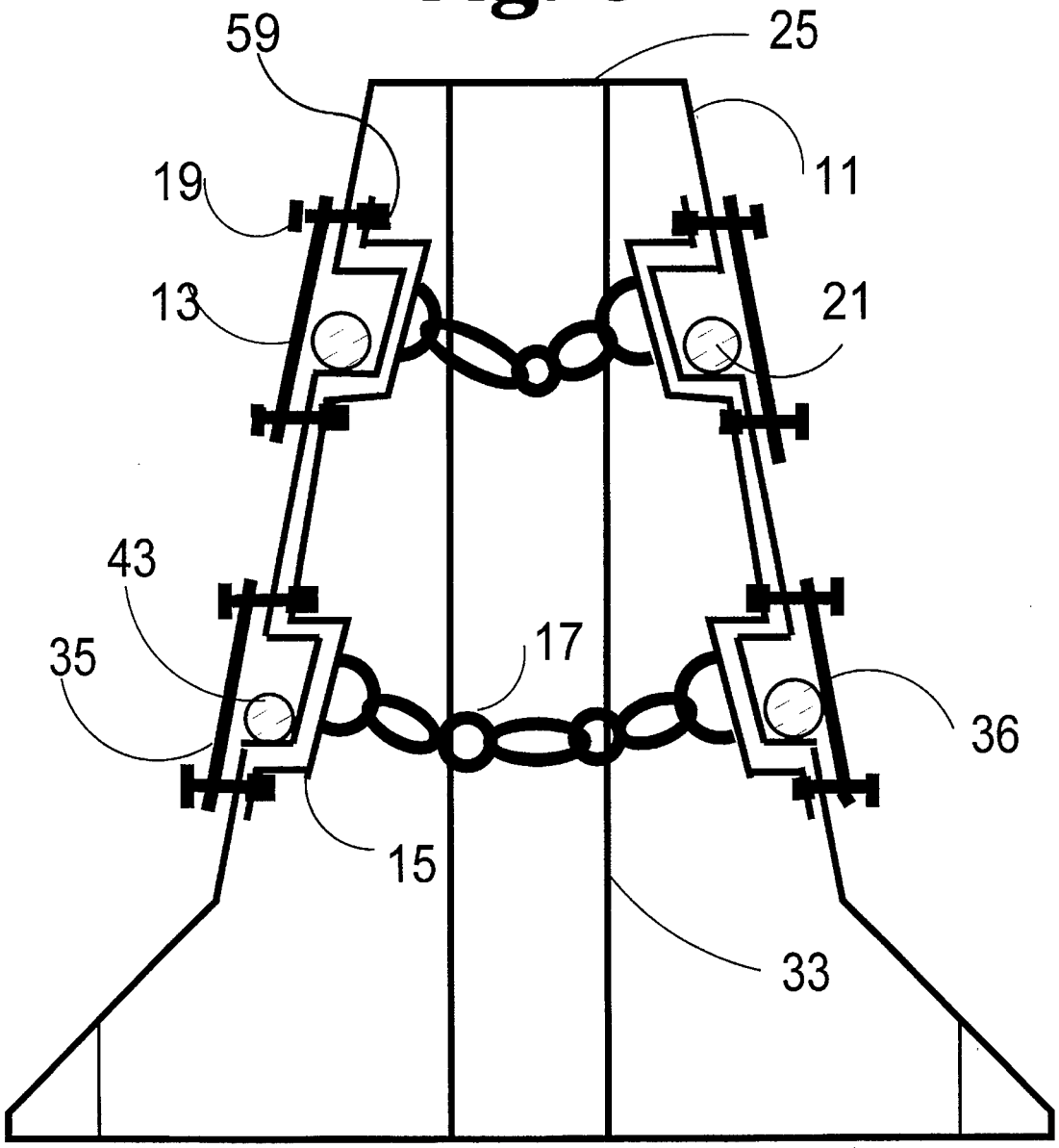
FIG. 5 is a view in cross-section along lines 5—5 of FIG. 4.

Referring now to FIGS. 4 and 5, a New Jersey style barricade system will typically comprise a plurality of individual hollow molded water-fillable barriers of the type shown aligned end-to-end. The barrier of these two figures is generally like that of FIGS. 1–3, however, rather than a pair of opposed end wall notches, one end wall has a notch 33 and the opposite end wall has a mating protrusion 27. When two barriers are joined, the protrusion of one extends into the notch of an adjacent one. The central space for receiving a connecting pin or an upper clevis and lower clevis is lost and the reinforcing cables now extend along the outside of the sidewalls in grooves such as 29 and 31. The barrier of FIGS. 4 and 5 also differs from that described earlier by the presence of four tapered notches such as 23 in the base portion. These are useful for staking the barrier in place in certain applications. Filling holes like those of the earlier embodiment are found in the top wall 25.

For joining adjacent barrier ends, there are four longitudinally extending cable receiving grooves with one cable such as 21 or 43 disposed in each groove. The grooves will accommodate a wide range of cable sizes, with cables up to 1¼ inches in diameter being contemplated. As in the earlier embodiment, the cable opposite ends terminate in closed loops or bights near the two barrier ends. For retaining respective cables in corresponding grooves, outer metal plates such as 13 and 35 are fastened to the barrier, for example, by bolts 19 with each metal plate spanning its corresponding groove. There are metal plates such as 15 within the barrier and generally aligned with corresponding outer metal plates 13 and a plurality of metal fasteners such as the bolts 19 pass through the outer plate and threadedly engage the insert 59 of the interior metal plate 15. Thus, it will be seen that the two outer plates 13 and 35 are interconnected by the metal strap 15 which extends generally vertically along the interior surface of the barrier while two opposed outer plates such as 35 and 36 are interconnected, by way of bolts and inner plates, by a chain 17. The longitudinally extending reinforcing members such as the steel cables 43 and 21 as well as the transverse reinforcing members such as chain as 17 are flexible and effective primarily in tension only. Clearly, cables could be employed where chains are illustrated and chains could be substituted for cables if desired.

Figure 5A:
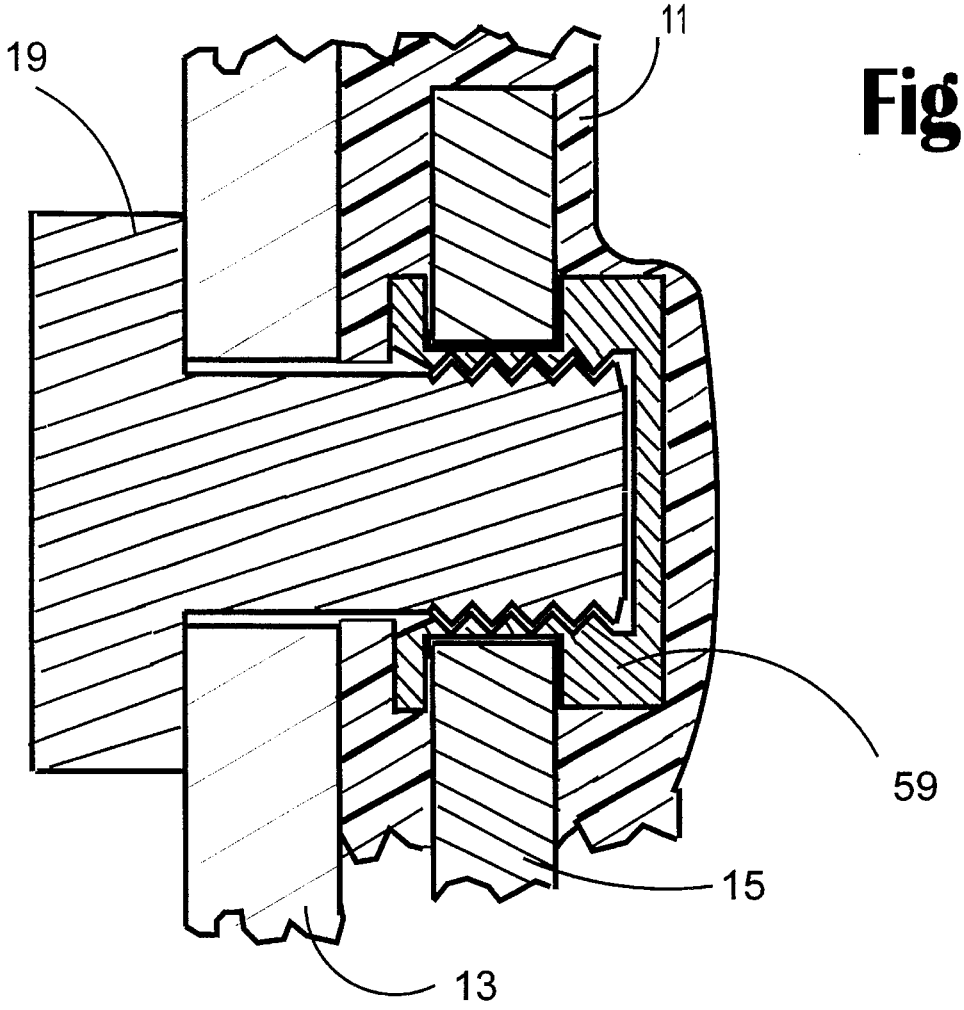
FIG. 5*a* is an enlarged view of a portion of FIG. 5 illustrating a bolt passing through the barrier sidewall.

The individual barriers are filled on site with ballast such as sand or water. If water is used, some care must be taken to insure the barriers are water-tight. FIG. 5*a* shows an illustrative one of the bolts 19 as it passes through the outer plate 13, past the outer surface of the barrier sidewall 11 and into the metal strap or plate 15. Strap 15 is formed with a cap 59 having a threaded blind hole. When barrier 11 is rotationally molded, mandrels are threaded into the caps 59 and plastic flows about both the caps 59 and plates 15 forming a water-tight seal.

The cable closed loops near the end of one barrier may be connected to similar closed loops near the end of an adjacent barrier by two pins similar to the one discussed earlier in conjunction with FIG. 6*a*, each passing through a pair of upper loops and a pair of lower loops. Alternately, and preferably, a clevis such as 65 as best seen in FIG. 6*c* may be provided for each adjacent pair of closed loops. The cable receiving grooves may be widened somewhat as shown at 61 and 63 to provide adequate space for connecting such a clevis. This is particularly helpful when the cables are somewhat shorter than illustrated.

FIG. 6*c* shows the preferred way in which two cables are joined and is equally applicable to either embodiment. Cable loops such as 69 and 77 are formed as a Flemish eye. The cable 75 is looped at 69 and the free end joined to an intermediate section of the cable by crimping or casting a sleeve 73 about the two cable sections. The use of a single pin through upper and lower pairs of cable loops is not preferred since that pin could be dislodged becoming a dangerous projectile when a vehicle impacts one or more barriers. Preferably, a commercially available clevis such as 65 is looped through each bight 69 and 77, and the screw 67 inserted and tightened to close the loop. In some cases, the screw 67 is tack welded at 71 to insure it is not removed by vandals or otherwise lost destroying the integrity of the interconnection of the barriers.

The barriers are not limited to any particular size, however, for illustrative purposes only, a typical barrier is about two feet in width, about three and one-half feet tall, and eight to twelve feet in length.

In summary, the invention has a number of advantages over known prior barrier schemes. The advantages of a hollow water filled barrier are retained while providing a secure and easily effected junction between adjacent barriers. The barrier of FIGS. 1–3 has longitudinal reinforcement in the form of the tubes 28 and 41 as well as the cables 39 and 45. The barrier of FIGS. 4 and 5 has longitudinal reinforcement in the form of cables 21 and 43, transverse reinforcement in the form of chains 17 and vertical reinforcement in the form of metal plates or straps 15.

From the foregoing, it is now apparent that a novel water-fillable New Jersey style barrier system has been disclosed meeting the objects and advantageous features set out hereinbefore as well as others, and that numerous modifications as to the precise shapes, configurations and details may be made by those having ordinary skill in the art. For example, features of one embodiment may easily be incorporated into the other. While individual cables are shown for each barrier and joined as by a clevis to the cables of an adjacent barrier, longer cables shared by several barriers could be used. These as well as other modifications may be made without departing from the spirit of the invention or the scope thereof as set out by the claims which follow.

What is claimed is:

1. In a New Jersey style barricade system having a plurality of individual hollow molded water-fillable barriers each having interior and exterior surfaces, the barriers being aligned end-to-end in the barricade system, an improved system for joining adjacent barrier ends comprising:

a plurality of longitudinally extending cable receiving grooves in each barrier;

a cable disposed in each groove, each cable having opposite ends terminating in closed loops near respective barrier ends;

means associated with each cable for retaining respective cables in corresponding grooves;

means within each barrier for interconnecting the means for retaining one cable and the means for retaining another cable; and means for coupling the closed loops near the end of one barrier to the closed loops near the end of an adjacent barrier.

2. The improvement of claim 1 wherein the means for coupling comprises a clevis for each adjacent pair of closed loops.

3. The improvement of claim 1 wherein the means for interconnecting comprises a chain.

4. The improvement of claim 1 wherein the means for interconnecting comprises a metal strap extending generally vertically along the interior surface of the barrier.

5. The improvement of claim 1 wherein the means for retaining comprises a first metal plate spanning the corresponding groove, a second metal plate within the barrier and generally aligned with the first metal plate, and a plurality of metal fasteners passing through the first plate, through the barrier and into the second metal plate.

6. The improvement of claim 5 wherein the means for coupling comprises a clevis for each adjacent pair of closed loops and the means for interconnecting comprises a chain.

7. An elongated hollow rotationally molded high density polyethylene highway barrier having a pair of elongated generally parallel sidewalls, a plurality of generally vertical internal reinforcing members extending along each sidewall, a plurality of external longitudinally extending reinforcing members, and a plurality of internal transverse reinforcing members spanning the barrier between a vertical reinforcing member extending along one side wall and a corresponding reinforcing member extending along the opposite sidewall.

8. The highway barrier of claim 7 further including means extending through at least one sidewall to interconnect one external longitudinally extending reinforcing member to a corresponding internal vertical reinforcing member and transverse reinforcing member.

9. The highway barrier of claim 7 including a pair of generally vertical end walls having top and bottom edges, one having a central vertical protrusion extending from the top edge to the bottom edge, and the other having a central vertical notch extending from the top edge to the bottom edge, the protrusion and notch arranged so that the notch end of one barrier may be aligned with the protrusion end of another barrier and the two barriers moved toward one another with the notch receiving the protrusion to aid in maintaining alignment of the two barriers.

10. The highway barrier of claim 7 wherein the longitudinally extending reinforcing members and the transverse reinforcing members provide reinforcement in tension only.

11. The highway barrier of claim 7 containing four longitudinally extending members, two to either side thereof; four generally vertical members, two to either side thereof; and four transverse members, each extending from one barrier side to the other.

12. An elongated hollow rotationally molded high density polyethylene highway barrier having a pair of elongated generally parallel sidewalls, a pair of generally vertical end walls, a plurality of internal longitudinal reinforcing members comprising a pair of hollow plastic tubes extending through the end walls to provide a pair of hollow cores through the barrier from one end to the other, and the means for joining one barrier to an adjacent barrier comprises a pair of cables, one passing through each tube, and each cable having a bight at each free end for connection with an adjacent barrier, the internal longitudinal reinforcing members extending from one end wall to the other, and means extending from respective vertical end walls for joining one barrier to an adjacent barrier.

13. The highway barrier of claim 12 wherein both end walls have central vertical notches arranged so that the notch end of one barrier may be aligned with the notch end of another barrier and the two barriers moved toward one another with the notches aligned and the extending means of one joined to the extending means of the other to aid in maintaining alignment of the two barriers.

14. An elongated hollow rotationally molded high density polyethylene New Jersey style highway barrier having a pair of elongated generally parallel sidewalls, a pair of generally parallel longitudinally extending cable receiving grooves in each sidewall, a pair of generally vertical end walls, at least two removable longitudinal reinforcing members extending from one vertical end wall to the other and extending from respective vertical end walls for joining one barrier to an adjacent barrier, the longitudinal reinforcing members comprising a plurality of cables, one cable disposed in each groove, each cable having opposite ends terminating in closed loops near respective barrier ends for connection with an adjacent barrier.

15. The highway barrier of claim 14 further comprising means associated with each cable for retaining respective cables in corresponding grooves, means within each barrier for interconnecting the means for retaining one cable and the means for retaining another cable; and means for coupling the closed loops near the end of one barrier to the closed loops near the end of an adjacent barrier.

16. The highway barrier of claim 15 wherein the means for retaining comprises a first metal plate spanning the corresponding groove, a second metal plate within the barrier and generally aligned with the first metal plate, and a plurality of metal fasteners passing through the first plate, through the barrier and into the second metal plate, and the means for interconnecting comprises a chain.

17. The highway barrier of claim 15 wherein the means for retaining comprises a first metal plate spanning the corresponding groove, and a plurality of metal fasteners passing through the first plate and through the barrier, the means for interconnecting comprising a metal strap extending generally vertically along the interior surface of the barrier, and the metal fasteners threadedly engaging respective metal straps.

* * * * *